US011221641B2

(12) United States Patent
Williams et al.

(10) Patent No.: US 11,221,641 B2
(45) Date of Patent: Jan. 11, 2022

(54) ROTATABLE CONTROL DEVICE WITH AXIAL TRANSLATION

(71) Applicant: SNAP-ON INCORPORATED, Kenosha, WI (US)

(72) Inventors: John R. Williams, Brasstown, NC (US); Richard D. Bothmann, Grayslake, IL (US)

(73) Assignee: SNAP-ON INCORPORATED, Kenosha, WI (US)

( * ) Notice: Subject to any disclaimer, the term of this patent is extended or adjusted under 35 U.S.C. 154(b) by 184 days.

(21) Appl. No.: 16/580,070

(22) Filed: Sep. 24, 2019

(65) Prior Publication Data

US 2020/0019204 A1 Jan. 16, 2020

Related U.S. Application Data

(62) Division of application No. 14/638,627, filed on Mar. 4, 2015, now Pat. No. 10,528,073.

(51) Int. Cl.

| | |
|---|---|
| ***G05G 1/08*** | (2006.01) |
| ***G05G 5/06*** | (2006.01) |
| ***H01H 25/06*** | (2006.01) |

(52) U.S. Cl.

CPC ..... *G05G 1/08* (2013.01); *G05G 5/06* (2013.01); *H01H 25/06* (2013.01)

(58) Field of Classification Search

CPC ..... H01H 19/14; H01H 19/585; H01H 19/58; H01H 19/63; H01H 19/6355; H01H 25/06; G05G 1/08; G05G 5/06; B25D 9/19; B25D 9/22; B25D 9/20

USPC ..... 173/218, 168, 169; 200/336

See application file for complete search history.

(56) References Cited

U.S. PATENT DOCUMENTS 3,354,732 A * 11/1967 Wickham ..... B25B 21/00 74/99 R
3,924,692 A * 12/1975 Saari ..... B25C 1/06 173/117
3,924,961 A * 12/1975 Hess ..... B25B 21/02 415/32
4,016,941 A * 4/1977 Sanders ..... B23D 29/00 173/170

(Continued)

FOREIGN PATENT DOCUMENTS

CN 2593980 Y 12/2003
CN 100532022 C 8/2009

(Continued)

OTHER PUBLICATIONS

UK Examination Report for Application No. 1521737.5 dated Jul. 27, 2017, 4 pages.

(Continued)

*Primary Examiner* — Dariush Seif
(74) *Attorney, Agent, or Firm* — Seyfarth Shaw LLP

(57) ABSTRACT

A mechanism for causing axial movement of a device, such as a pin, by rotating a knob in a rotational direction. The knob includes cam surfaces that, when rotated, axially adjust the device by bending an elastic frame so a portion of the frame moves toward the desired axial direction. The frame can be disposed in a substantially flush or otherwise compact manner to improve the aesthetic appearance of the mechanism and allow for a more compact and cost-effective knob.

10 Claims, 8 Drawing Sheets

(56) References Cited

U.S. PATENT DOCUMENTS 4,315,143 A * 2/1982 Willinger ..... H05B 3/80 119/73
4,823,885 A * 4/1989 Okumura ..... B23B 45/008 173/178
4,914,928 A * 4/1990 Fellwock ..... F25D 17/045 62/408
6,062,323 A * 5/2000 Pusateri ..... B25B 21/02 173/169
6,082,468 A * 7/2000 Pusateri ..... B25B 21/00 173/162.2
6,196,943 B1 * 3/2001 Chen ..... B25B 21/00 475/254
6,220,114 B1 * 4/2001 Ray ..... G05G 5/06 74/527
6,274,835 B1 * 8/2001 Mo ..... H01H 19/63 200/564
6,693,248 B1 * 2/2004 Schultz ..... H01H 51/08 200/1 R
6,796,386 B2 * 9/2004 Izumisawa ..... B25B 21/02 173/93.5
6,883,619 B1 * 4/2005 Huang ..... B25B 21/02 173/168
6,932,166 B1 * 8/2005 Kirsch ..... B22D 31/00 173/206
7,214,894 B1 * 5/2007 Kakuno ..... H01H 25/04 200/329
7,223,926 B1 * 5/2007 Gannon ..... G05G 1/082 200/11 R
7,644,783 B2 * 1/2010 Roberts ..... B25B 23/141 173/178
7,708,084 B2 * 5/2010 Duesselberg ..... B25F 5/001 173/48
7,717,192 B2 * 5/2010 Schroeder ..... B25D 16/006 173/48
7,802,633 B2 * 9/2010 Kobayashi ..... B25F 5/00 173/218
7,896,101 B2 * 3/2011 Wakabayashi ..... B25B 21/00 173/169
7,982,153 B2 * 7/2011 Lin ..... H01H 19/11 200/568
8,647,084 B2 * 2/2014 Chang ..... F01C 1/3446 418/15
10,072,615 B2 * 9/2018 Pattullo ..... B01F 3/0446
2004/0016630 A1 * 1/2004 Muller ..... H01H 19/63 200/564
2006/0227454 A1 * 10/2006 Ruettiger ..... H01H 25/06 360/97.11
2007/0095409 A1 * 5/2007 Chen ..... B25B 23/145 137/625.21
2007/0199806 A1 * 8/2007 Da Dalt ..... H01H 19/6355 200/11 R
2008/0115635 A1 * 5/2008 Hellstrom ..... B25B 21/00 81/470
2008/0116047 A1 * 5/2008 Kim ..... G04G 21/00 200/336
2008/0197004 A1 * 8/2008 Ishigaki ..... H01H 9/24 200/336
2011/0035902 A1 * 2/2011 Ikeda ..... H01H 25/06 16/110.1
2012/0247934 A1 * 10/2012 Schmidt ..... H01H 19/14 200/336
2013/0220779 A1 * 8/2013 Kerner ..... H01H 19/11 200/4
2013/0270082 A1 * 10/2013 Harazawa ..... G06F 3/0338 200/329
2015/0158168 A1 * 6/2015 Lauterwald ..... B25D 16/006 173/48
2015/0221426 A1 * 8/2015 Furuki ..... G06F 3/0362 335/219
2016/0023344 A1 * 1/2016 Bernhart ..... G05G 1/10 173/48
2016/0260559 A1 * 9/2016 Williams ..... G05G 5/06
2017/0352505 A1 * 12/2017 Wang ..... H01H 19/14

FOREIGN PATENT DOCUMENTS

GB 2421285 A 6/2006
TW 222241 B 4/1994
TW 367926 U 8/1999
TW 410715 U 11/2000
TW 201210754 A 3/2012
TW 201330994 A 8/2013
TW 201330994 A1 8/2013

OTHER PUBLICATIONS

Chinese Office Action for Application No. 201610120144.X dated Jul. 3, 2017, 8 pages.
Taiwan-Office Action, dated Sep. 14, 2016, 11 pages.
United Kingdom Intellectual Property Office Combined Search and Examination Report, dated Apr. 2, 2016; 9 pages.
Australian Government Patent Examination Report No. 1, dated Jan. 22, 2016; 5 pages.

* cited by examiner

ROTATABLE CONTROL DEVICE WITH AXIAL TRANSLATION

CROSS-REFERENCES TO RELATED APPLICATIONS

This application is a divisional application of and claims the benefit of U.S. patent application Ser. No. 14/638,627, filed Mar. 4, 2015, titled Rotatable Control Device with Axial Translation, the contents of which are incorporated herein by reference in their entirety.

The present invention also relates to the invention(s) disclosed in U.S. patent application Ser. No. 14/633,400, now U.S. Pat. No. 10,328,564, the disclosure of which is incorporated herein by reference in its entirety.

TECHNICAL FIELD OF THE INVENTION

The present invention relates generally to control devices. More particularly, the present invention relates broadly to a rotatable control device that converts rotational movement of a knob to axial translation.

BACKGROUND OF THE INVENTION

Tools and other devices often include knobs or other interfaces that control various components. For example, knobs can be used with pneumatic air tools to control the amount of air flow by controlling an internal valve to allow air to flow into a passage. Many power tools include knobs that are neither easy to control nor aesthetically pleasing. Instead, these knobs are often located at a lower corner of the tool. Typically, the knob is operably coupled to many internal air passages to control the air flow, increasing the risk of air leakage or otherwise result in pressure losses. Other conventional knobs locate the flow control components in a manner that increase the size of the tool or adversely affect the ergonomics or use of the tool, complicating the manufacturing process and increasing the cost of manufacturing the tool.

SUMMARY OF THE INVENTION

An embodiment of the present invention includes a mechanism for translating rotational movement of a rotatable knob to axial movement of an operably coupled device. The mechanism includes a rotatable knob having cam surfaces on a first side that, when rotated, axially move a pin or other device. The knob can interface with the pin through a bendable or elastic frame coupled to a housing in a substantially flush or otherwise compact manner to improve the aesthetic appearance and compact nature of the mechanism.

Another embodiment of the present invention comprises a control device including a knob rotatably coupled to a backside of a housing of a tool, for example, having a first surface facing the tool with a first cam surface extending partially along an outer periphery of the knob, where the first cam surface has a first raised portion at a first end that tapers to a first lower portion at a second end, a bendable or elastic frame coupled to the housing and having one or more contact surfaces adapted to cooperatively engage the first cam surface, and an axially translatable device disposed in the tool and which abuts or is coupled to a backside of one of the contact surfaces, wherein when the knob is rotated, it causes the first cam surface to rotate, wherein at least one of the contact surfaces follows the contour of the first cam surface and moves inwardly or outwardly relative to the tool, which causes the device to move axially inwardly or outwardly relative to the tool.

Moreover, one or more of the contact surfaces may include a detent structure, such as a convexity or other outward protrusion, that is adapted to cooperatively engage spaced detents disposed on the first cam surface, such as depressions, which are spaced apart relative to each other at intervals that represent specific amounts of axial displacement of the device, wherein rotation of the knob causes the detents to cooperatively engage to provide tactile and/or audible feedback to a user that a specific axial displacement of the device has been obtained, and the detents detain the knob from further rotation, thereby detaining the axial position of the device relative to the tool, unless additional rotational force is applied to the knob by the user.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION OF THE EMBODIMENTS

Figure 1:
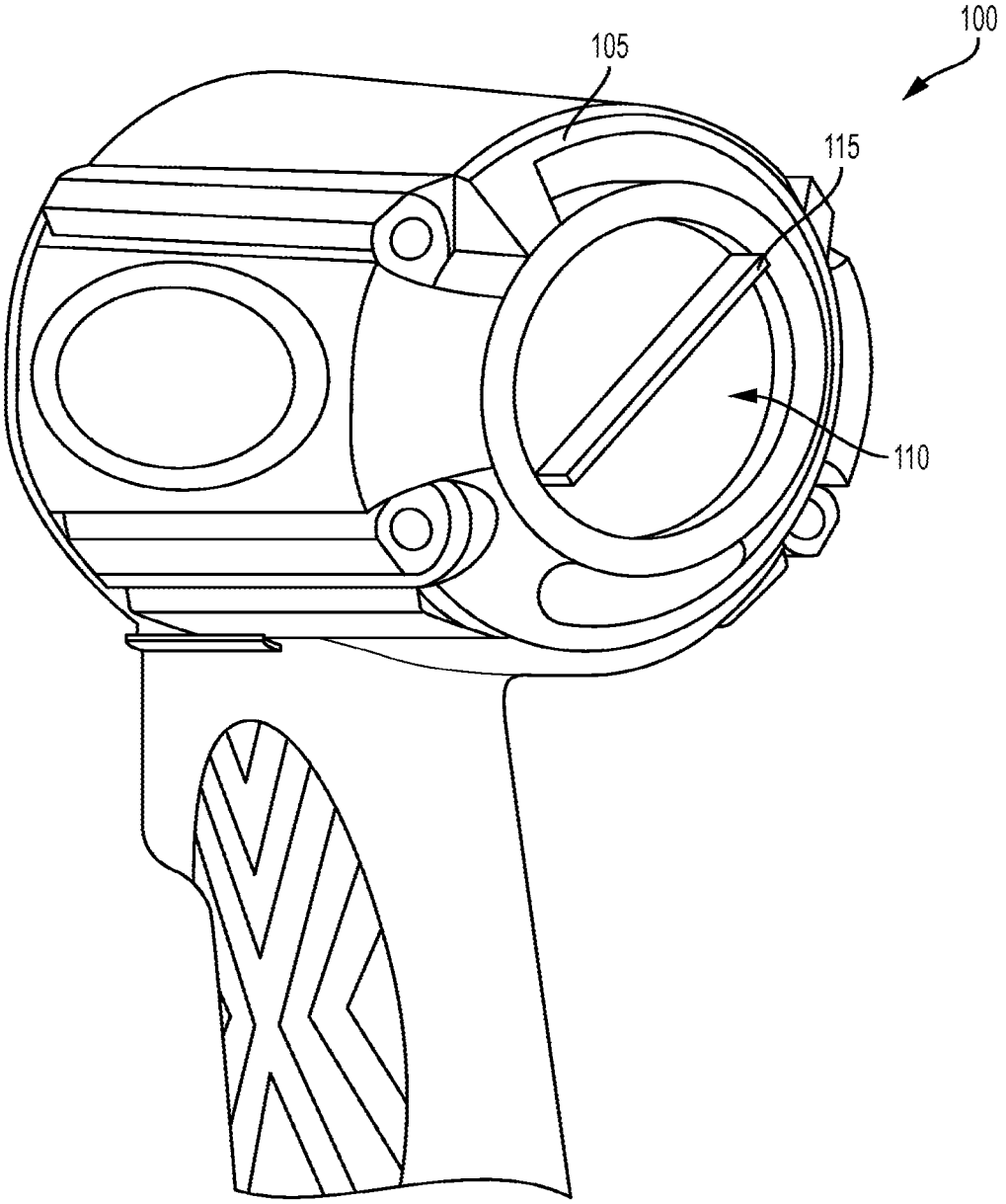
FIG. 1 is a partial rear perspective view of an embodiment of the present invention utilized on a tool.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated.

An embodiment of the present invention broadly comprises a mechanism that translates rotational movement into axial movement by rotating a knob in a rotational direction. The knob includes a first surface with one or more cam surfaces disposed along a peripheral edge of the knob. A bendable or elastic frame is disposed between the cam surfaces and an axially movable device to facilitate the axial movement of the device upon rotation of the knob. The knob can be rotatably coupled to a housing of a tool, such as a pneumatically powered tool, in a substantially flush or otherwise compact manner to improve the aesthetic appearance of the mechanism and allow for a more compact and cost-effective knob. It will be appreciated that while the present invention is discussed in terms of applicability and use with a tool, the present invention is adaptable and useable with any type of mechanism or device where rotational-to-axial translational movement is desired. Therefore, the present invention is not limited to use with a tool.

Referring to FIG. 1, a device, shown as tool 100, for example, includes a housing 105 and a knob 110 rotatably coupled to the housing 105. The knob 110 includes first 110*a* and second 110*b* knob surfaces, wherein the first knob surface 110*a* faces inwardly and the second knob surface 110*b* faces outwardly, relative to the housing 105. The knob 110 can include an outwardly extending handle or grip 115 disposed radially across the knob second surface 110*b* to assist a user in gripping the knob 110 for rotational movement. In an embodiment, the outer circumferential surface of the knob 110 can be textured, such a knurled, for better grip during rotational movement. In an embodiment, and when used with a powered tool, when rotated, the knob 110 is adapted to cause regulation of motor power. However, it will be appreciated that the knob 110 is not so limited, and can be implemented in any form to cause axial movement of any device when rotated. Moreover, in an embodiment, the outer circumferential edge of the knob 110 may include an annular groove having a sealing ring 117, such as an elastic or rubberized O-ring, disposed therein, so that when the knob 110 is rotatably coupled to the housing 105 in a recess configured to rotatably receive the knob 110, the sealing ring 117 cooperatively engages the wall of the recess to provide a substantially fluid-tight and/or air-tight relationship.

Figure 2:
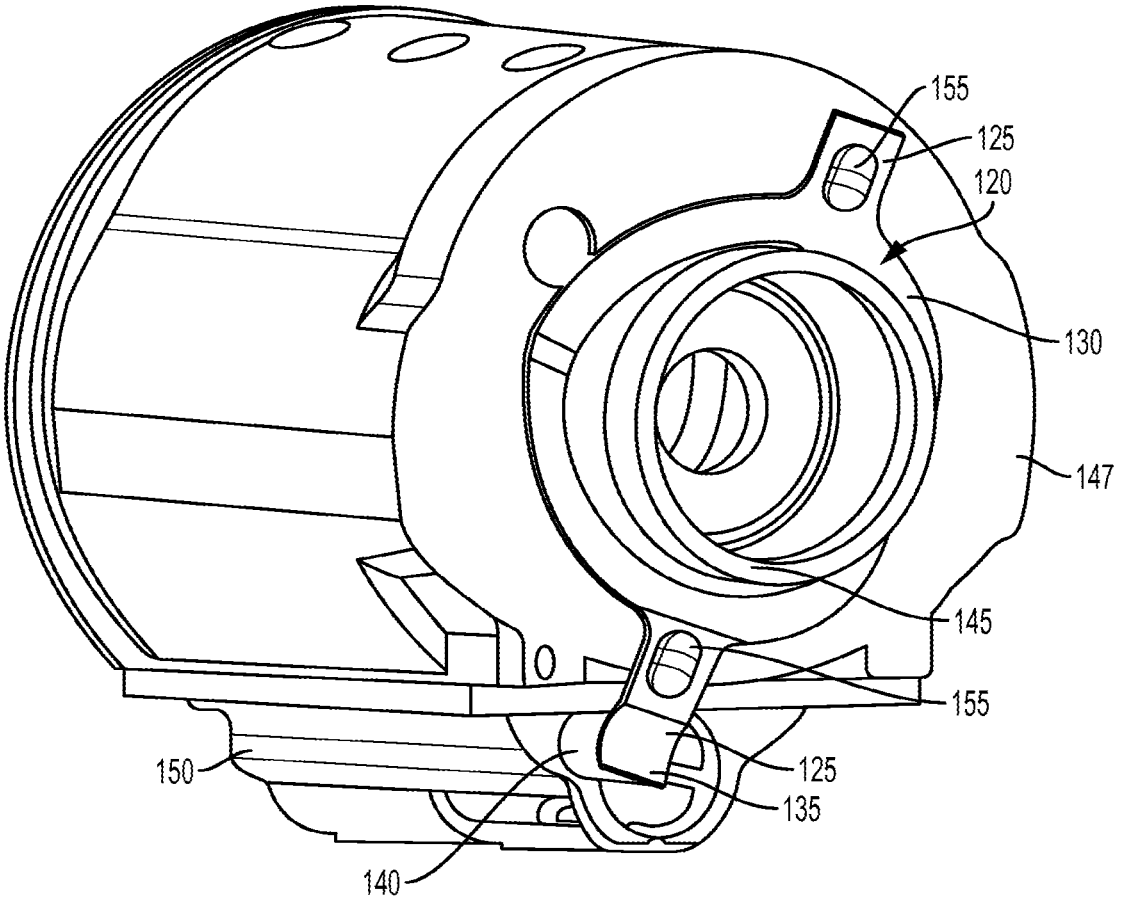
FIG. 2 is a rear perspective view of a cylinder, frame, and plate assembly according to embodiments of the present invention.

Referring to FIG. 2, a bendable or elastic, substantially annular frame 120, such as a rocker spring, includes diametrically opposing tabs 125, each having a contact surface, that extend radially outwardly from frame 120. In an embodiment, only one tab 125 is provided. An extension 135 can extend from a lower tab 125 and can be operably coupled to an axially movable device, such as a pin 140. In an embodiment, the extension 135 has a surface that abuts or contacts pin 140. The pin 140 is adapted to move axially relative to the frame 120, and can be any device where axial movement is desired and achievable.

Figure 3:
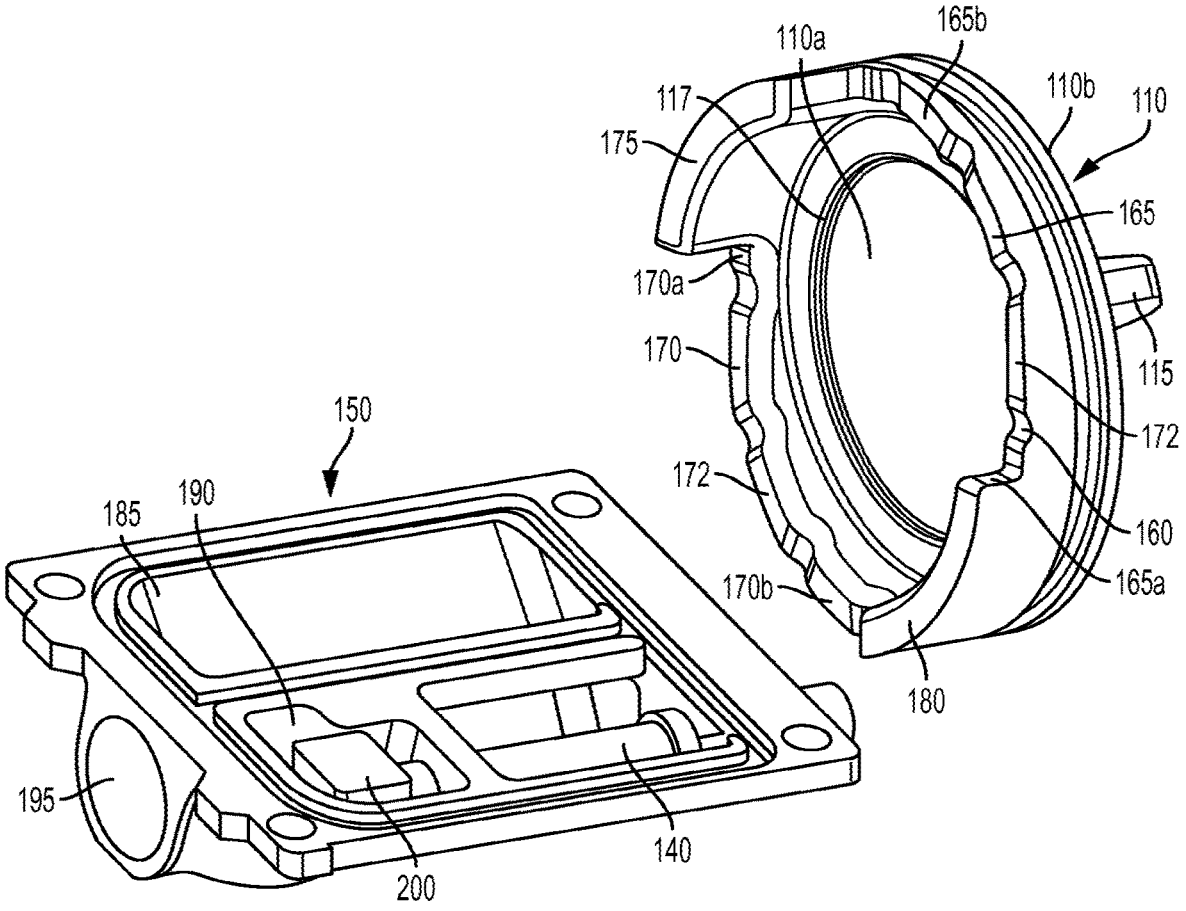
FIG. 3 is a partial exploded front perspective view of a plate and knob according to embodiments of the present invention.

Referring also to FIG. 3, the knob 110 can include a first cam surface 165 arcuately disposed around the outer periphery of the first knob surface 110*a* having a first raised portion 165*a* at a first end tapering to a first lower portion 165*b* at a second end. Similarly, the knob 110 can include a second cam surface 170 diametrically opposite of the first cam surface 165 and having a second raised portion 170*a* at a first end tapering to a second lower portion 170*b* at a second end. The first cam surface 165 and second cam surface 170 can extend from a first wall 175 and a second wall 180 around an outer periphery of the knob 110.

The cam surfaces 165, 170 can be tapered in any manner. For example, the cam surfaces 165, 170 can be raised at a clockwise-most position and lower at a counterclockwise-most position, or vice versa. The cam surfaces 165, 170 can also be tapered opposite one another, but in an embodiment, the cam surfaces 165, 170 are sloped in the same rotational direction to provide a tilting effect to the frame 120 during operation, as described below. Further, the walls 175, 180 can act as stops to substantially prevent over-rotation of the knob 110 during use. For example, the walls 175, 180 can rotate with the knob 110 and abut against the tabs 125 when rotated against the frame 120, thus preventing further rotation of the knob 110.

Figure 5A:
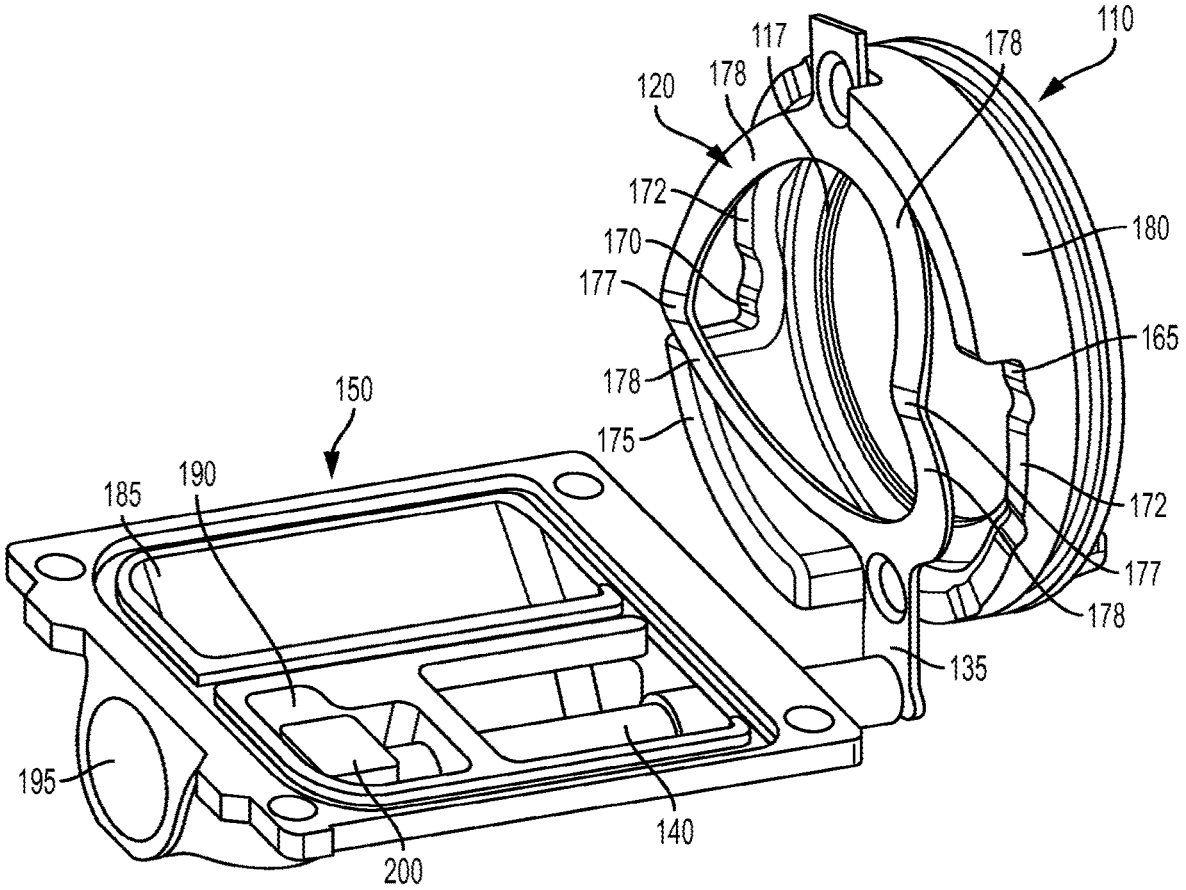
FIG. 5A is a partial assembled front perspective view of various components of embodiments of the present invention.
Figure 5B:
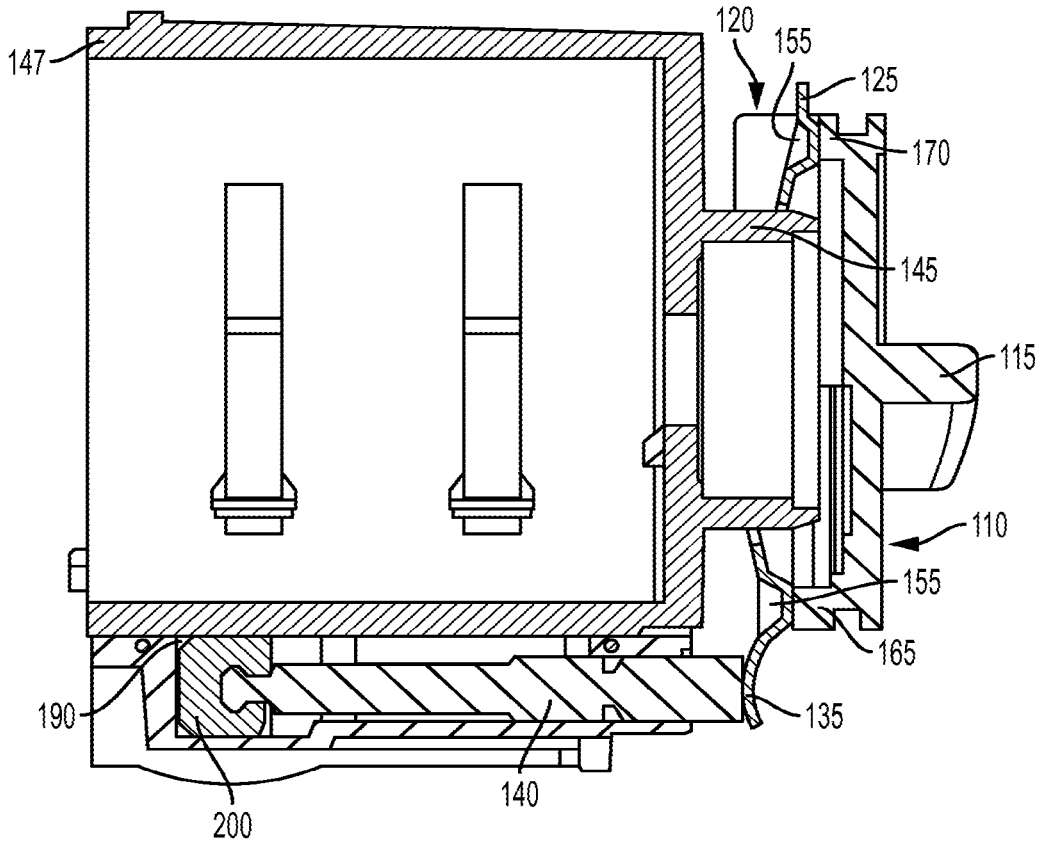
FIG. 5B is a partial side sectional view of various components of embodiments of the present invention.

As shown, rotational movement of the knob 110 causes rotational movement of the cam surfaces 165, 170. The tabs 125 respectively cooperatively engage respective cam surfaces 165, 170, and follow the profile of the cam surfaces 165, 170, during rotation of the knob 110. Therefore, the tabs 125 move axially inwardly and outwardly, relative to the housing 105, when the knob 110 is rotated and depending on the profile of the cam surfaces 165, 170 that abut the tabs 125. For example, and as shown in FIGS. 5A and 5B, clockwise rotation of the knob 110 causes the profiles of the cam surfaces 165, 170 to move from a first distance relative to the housing 105 to a second, closer distance relative to the housing 105, due to the tapered nature of the cam surfaces 165, 170. Therefore, during rotation of the knob 110, the tabs 125 abut and cooperatively engage the cam surfaces 165, 170, and the lower tab 125 can move axially inward relative to the housing 105, while the upper tab 125 moves axially outward, due to the profiles of the cam surfaces 165, 170. The cam surfaces 165, 170 accordingly change the distance of the tabs 125 relative to the housing 105 in opposite directions, and in so doing, cause the frame 120 to apply a constant force to the knob 110. Therefore, because lower tab 125 moves inwardly relative to the housing 105, the extension 135 moves inwardly as well. When extension 135 moves inwardly, it pushes the pin 140 axially inward, thus translating the rotational movement of the knob 110 to axial movement of the pin 140.

Figure 4A:
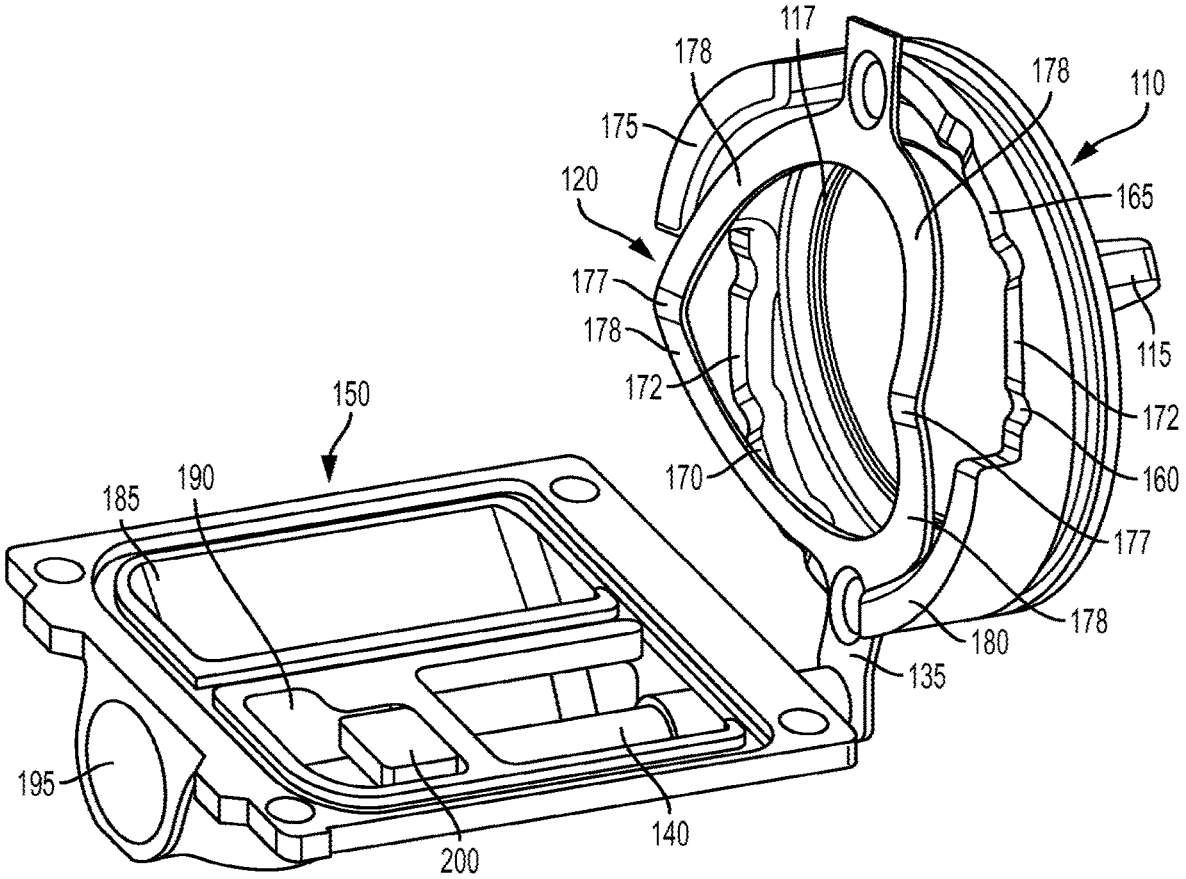
FIG. 4A is a partial assembled front perspective view of various components of embodiments of the present invention.
Figure 4B:
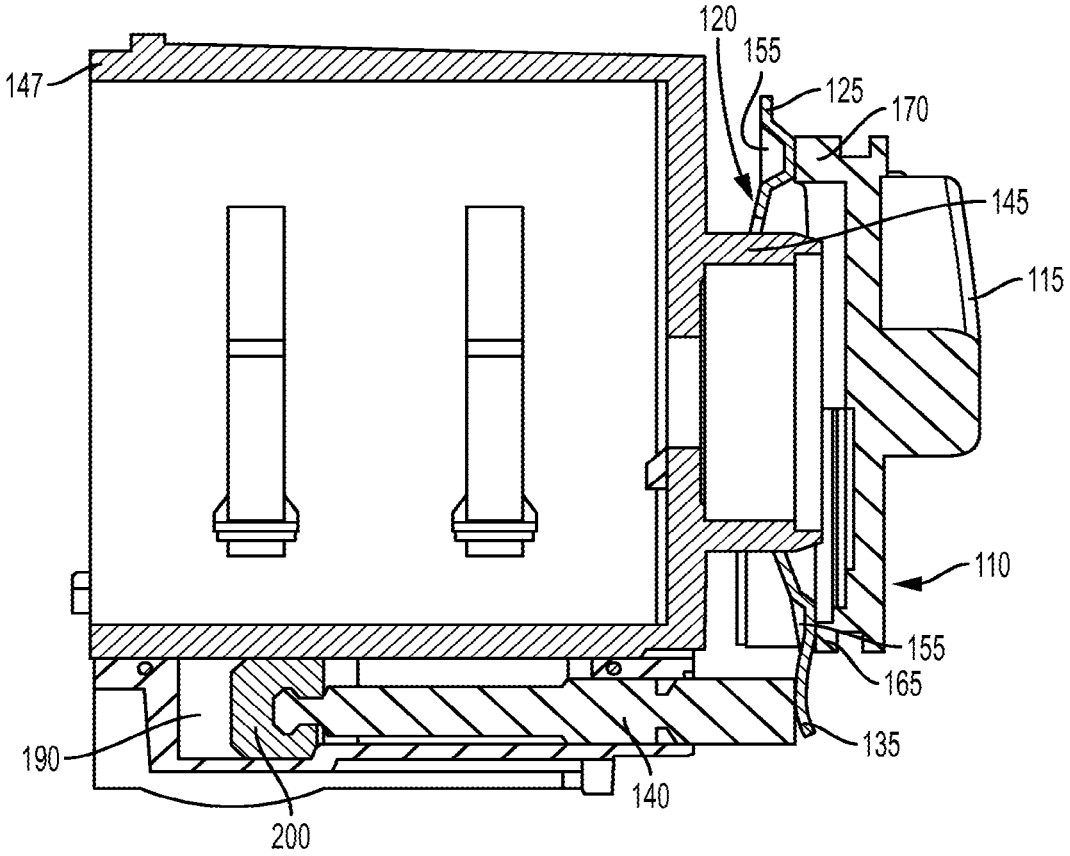
FIG. 4B is a partial side sectional view of various components of embodiments of the present invention.

Likewise, when the knob 110 is rotated in the opposite rotational direction, and due to the bendable or elastic nature of the frame 120, which biases the frame 120 outwardly relative to the housing 105, the lower tab 125 moves axially outward, relative to the housing 105, and the upper tab 125 moves axially inward, due to the tapered nature of the cam surfaces 165, 170. Therefore, during rotation of the knob 110, and because the tabs 125 abut and cooperatively engage the cam surfaces 165, 170, the lower tab 125 moves axially outward relative to the housing 105, due to the profiles of the cam surfaces 165, 170, as shown in FIGS. 4A and 4B. Because the lower tab 125 moves outwardly relative to the housing 105, the extension 135 moves outwardly as well. When the extension 135 moves outwardly, it either pulls the pin 140 axially outwardly, if the pin 140 is coupled to extension 135, or allows the pin 140 to move axially outwardly, if the pin 140 is biased outwardly by, for example, a spring or other biasing structure.

In an embodiment, one or more of the surfaces of the tabs 125 that contact cam surfaces 165, 170 may include a detent structure, such as a convexity or other outward protrusion 155. In an embodiment, the convexity or outward protrusion 155 is oblong or oval in shape. The protrusion 155 is adapted to cooperatively engage spaced detents 160 disposed on the cam surfaces 165, 170, such as depressions or steps, which can be spaced apart at specific intervals to represent specific amounts of axial displacement of the pin 140. The detents 160 can extend in a direction parallel to the first face 110*a* of the knob 110 in a stepped configuration, as shown in FIG. 3, or can extend at the same angle as surface portions 172. Rotation of the knob 110 causes the protrusion 155 to cooperatively engage the detent 160 to provide tactile and/or audible feedback to a user that a specific axial displacement of the pin 140 has been obtained. Moreover, the protrusion 155 and detent 160 interface can detain the knob 110 from further rotation unless additional rotational force is applied by the user, thus also detaining the axial position of the pin 140.

Figure 6:
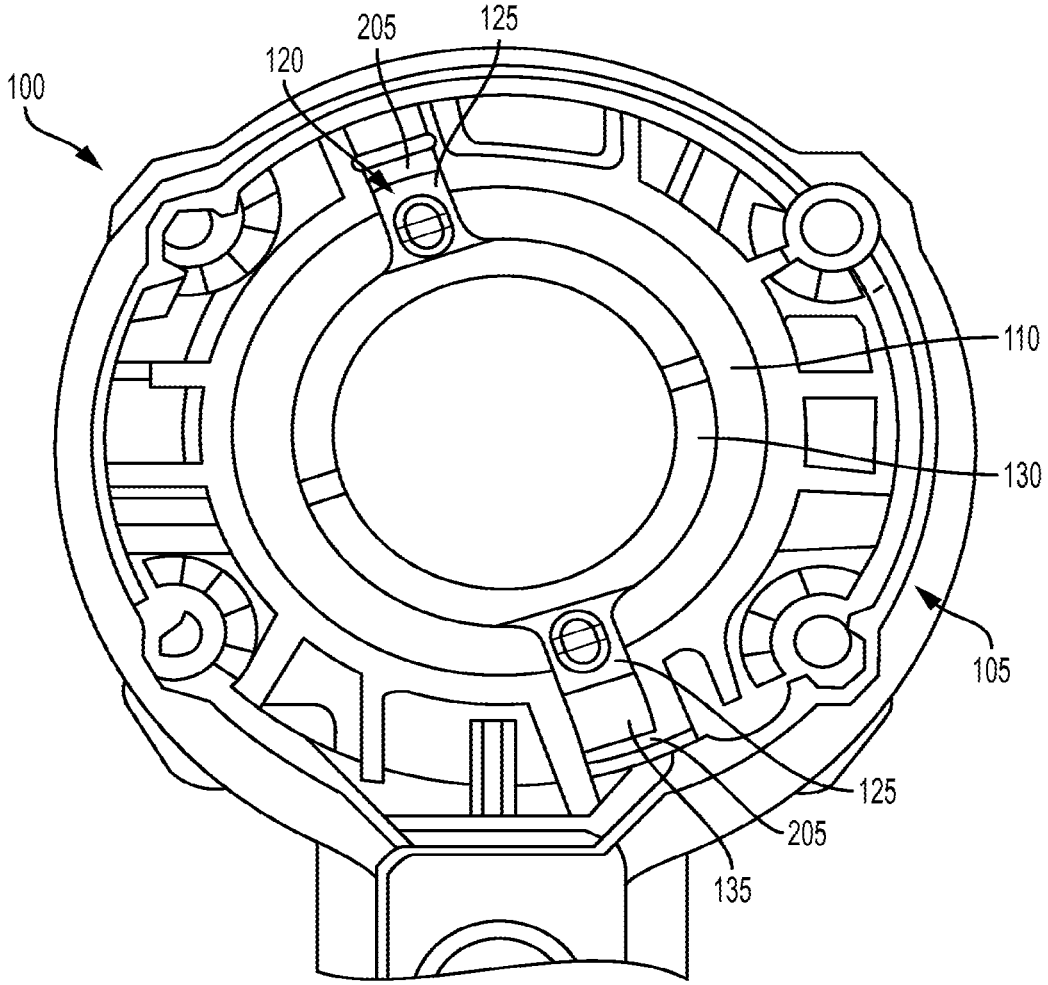
FIG. 6 is a partial front sectional view of an embodiment of the present invention.

Referring to FIG. 6, the frame 120 can be coupled to the housing 105 to prevent rotation and radial displacement of the frame 120 relative to the knob 110. For example, the frame 120 can be radially constrained by an outwardly extending cylinder 147 disposed on the housing 105. In an embodiment, the tabs 125 can also be disposed in receiving grooves 205 disposed on the housing 105 to prevent rotation of the frame 120 relative to the housing 105 and knob 110, but still allowing axial movement of the tabs 125 when the frame 120 flexes during use.

In an embodiment, the cam surfaces 165, 170 can be cooperatively configured and tapered so opposing tabs 125 can misalign relative to a plane, as shown in FIGS. 4B and 5B. For example, the frame 120 can flex under the force of the cam surfaces 165, 170, thus causing tabs 125 to planarly misalign. It has been found that such planar misalignment provides a better balance of the present invention. In particular, the flexing stresses placed on one of the tabs 125, caused by one of the cam surfaces 165, counter-balances the flexing stresses place on the opposing tab 125, caused by the opposing cam surface 175.

The frame 120 can include mid-portions 177 with radial portions 178 extending from the mid-portions 177. The mid-portions 177 and the radial portions 178 can be integrally formed, but the mid-portions 177 can be angled or bent with respect to the radial portions 178. Accordingly, the radial portions 178 can flex or bend with respect to the mid-portions 177 when contacting the housing 105, therefore providing a rocker effect to the frame 120.

As shown in FIG. 2, the frame 120 can be substantially flush with or otherwise compactly disposed against the housing 105 for a compact and space-efficient assembly. For example, the circumferential section 130 can surround a ring 145 and can be located at or near the cylinder 147. This arrangement, in combination with the tab 125 and groove 205 interface, allow for an easy to implement and compact arrangement of the frame 120 within the tool 100. For example, the frame 120 can be movably coupled to the housing 105 by coupling the tabs 125 to the grooves 205 so that rotational movement of the frame 120 about its central axis is substantially prevented, but the frame 120 can still tilt, as discussed above.

The examples discussed above contemplate use of the present invention with a powered tool, such as a pneumatically powered tool. However, the present invention is not so limited, and can be implemented in any type of tool, or any type of device where rotational-to-axial translation is desired.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A tool comprising:

a housing having a notch;

a knob rotatably coupled to the housing and having a first cam surface, the first cam surface having opposing first and second first cam surface ends, and a first raised portion is disposed at the first first cam surface end and a first lower portion is disposed at the second first cam surface end; and a frame coupled to the housing and axially bendable based on rotation of the first cam surface, the frame having a first tab adapted to couple with the notch to prevent rotation of the frame.

2. The tool of claim 1, further comprising a cylinder outwardly extending from the housing and having an inlet opening.

3. The tool of claim 1, further comprising a detent coupled to the frame, wherein the first cam surface includes a tooth, and wherein the detent is adapted to engage the tooth to provide a tactile indication.

4. The tool of claim 1, further comprising a second cam surface extending from a second wall, the second cam surface having opposing first and second second cam surface ends, a second raised portion is disposed at the first second cam surface end and a second lower portion is disposed at the second second cam surface end.

5. The tool of claim 2, wherein the frame includes an extension and the first tab is located proximate to the extension, and further comprising a second tab opposite the first tab, wherein the first cam surface is adapted to contact the first tab and the second cam surface is adapted to contact the second tab based on rotation of the knob.

6. The tool of claim 5, wherein the first cam surface is adapted to push the first tab axially in a first direction, and the second cam surface is adapted to allow the extension to move axially in a second direction opposite the first direction when the knob is rotated in a first rotational direction.

7. The tool of claim 6, wherein the first cam surface is adapted to allow the first tab to move in the second direction, and the second cam surface is adapted to push the extension in the first direction when the knob is rotated in a second rotational direction.

8. The tool of claim 1, wherein the frame includes a circumferential portion, and further comprising a cylinder having a ring, and wherein the frame is matingly engages the ring.

9. The tool of claim 1, wherein the knob includes a handle extending radially across the knob.

10. A method of operating a control device, comprising:

rotating a knob in a first rotational direction, thereby causing a first cam surface of the knob to contact a frame, thereby causing the frame to tilt towards a first axial direction and axially move an object in the first axial direction; and rotating a knob in a second rotational direction, thereby causing a second cam surface of the knob to contact the frame, thereby causing the frame to tilt toward a second axial direction opposite the first axial direction and allow the object to move in the second axial direction.

* * * * *